US008591258B2

(12) United States Patent
Xiao et al.

(10) Patent No.: US 8,591,258 B2
(45) Date of Patent: Nov. 26, 2013

(54) ELECTRICAL CONNECTOR WITH BACK SHELL

(75) Inventors: Xue-Yuan Xiao, Kunshan (CN); Hong-Qiang Han, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 25 days.

(21) Appl. No.: 13/449,332

(22) Filed: Apr. 18, 2012

(65) Prior Publication Data

US 2012/0264333 A1 Oct. 18, 2012

(30) Foreign Application Priority Data

Apr. 18, 2011 (CN) ..... 2011 2 0113829 U

(51) Int. Cl.
*H01R 13/648* (2006.01)

(52) U.S. Cl.
USPC ..... 439/607.25; 439/541.5

(58) Field of Classification Search
USPC ..... 439/607.23–607.26, 607.35, 607.38, 439/607.4, 541.5
See application file for complete search history.

(56) References Cited

U.S. PATENT DOCUMENTS

| | | | | |
|---|---|---|---|---|
| 5,759,067 | A * | 6/1998 | Scheer | 439/607.26 |
| 7,241,174 | B2 * | 7/2007 | Tsai | 439/607.25 |
| 7,748,999 | B1 | 7/2010 | Sun et al. | |
| 7,887,373 | B1 | 2/2011 | Wang | |
| 7,967,631 | B2 * | 6/2011 | Wang et al. | 439/541.5 |
| 2002/0102879 | A1 * | 8/2002 | Hoshino et al. | 439/607 |

FOREIGN PATENT DOCUMENTS

| | | |
|---|---|---|
| CN | 201556813 | 8/2010 |

* cited by examiner

*Primary Examiner* — Phuong Dinh
(74) *Attorney, Agent, or Firm* — Wei Te Chung; Ming Chieh Chang

(57) ABSTRACT

An electrical connector (100) includes an insulative housing (1), a front shell (4) and a back shell (5) fixed to the insulative housing (1) and a set of contacts (2) received in the insulative housing (1). The back shell (5) includes a base (51) covering a rear surface of the insulative housing (1) and formed with mating plates (512). The insulative housing (1) has two guide slots (173) extending forwardly from a back face (17) of the insulative housing (1). The back shell (5) is assembled to the insulative housing (1) from top-to-bottom, the guiding slot (173) guides the mounting plate (512) and finally receives the mounting plate (512) to retain the back shell (5).

13 Claims, 11 Drawing Sheets

ELECTRICAL CONNECTOR WITH BACK SHELL

BACKGROUND OF THE INVENTION

1. Field of the Invention

The present invention generally relates to an electrical connector and more particularly to an electrical connector having a back shell which is mechanically retained to an insulative housing of the electrical connector.

2. Description of Related Art

Chinese patent No. 201556813, published on Aug. 18, 2010, discloses a conventional electrical connector including an insulative housing, a plurality of contacts retained in the insulative housing, a front shell covered a front of the insulative housing and a back shell covered a back of insulative housing. The front shell comprises a plurality of ribs. The back shell comprises a plurality of locking edges with through locking holes each of. The ribs are received in the locking holes to retain the back shell in the front shell. The back shell is retained to the insulative housing only by the ribs without any other retaining mechanism and the back shell may swing.

So, an improved connector is needed.

SUMMARY OF THE INVENTION

The present invention provides an electrical connector, which comprises an insulative housing having a back face in a back of the insulative housing and a top face in a top of the insulative housing, a plurality of contacts retained in the insulative housing and a back shell. The back shell comprises a base covered the back face of the insulative housing and an extending wall extending forwardly from a top edge of the base and covering the top face of the insulative housing. Wherein the insulative housing comprises at least one guiding slot depressed forwardly from the back face and upwardly passing through the insulative housing. The back shell is assembled to the insulative housing from a top-to-bottom direction and has at least one mounting plate extending forwardly from the base and sliding in the guiding slot to guide the back shell.

Other objects, advantages and novel features of the present invention will become more apparent from the following detailed description of the present embodiment when taken in conjunction with the accompanying drawings.

DETAILED DESCRIPTION OF THE INVENTION

Figure 1:
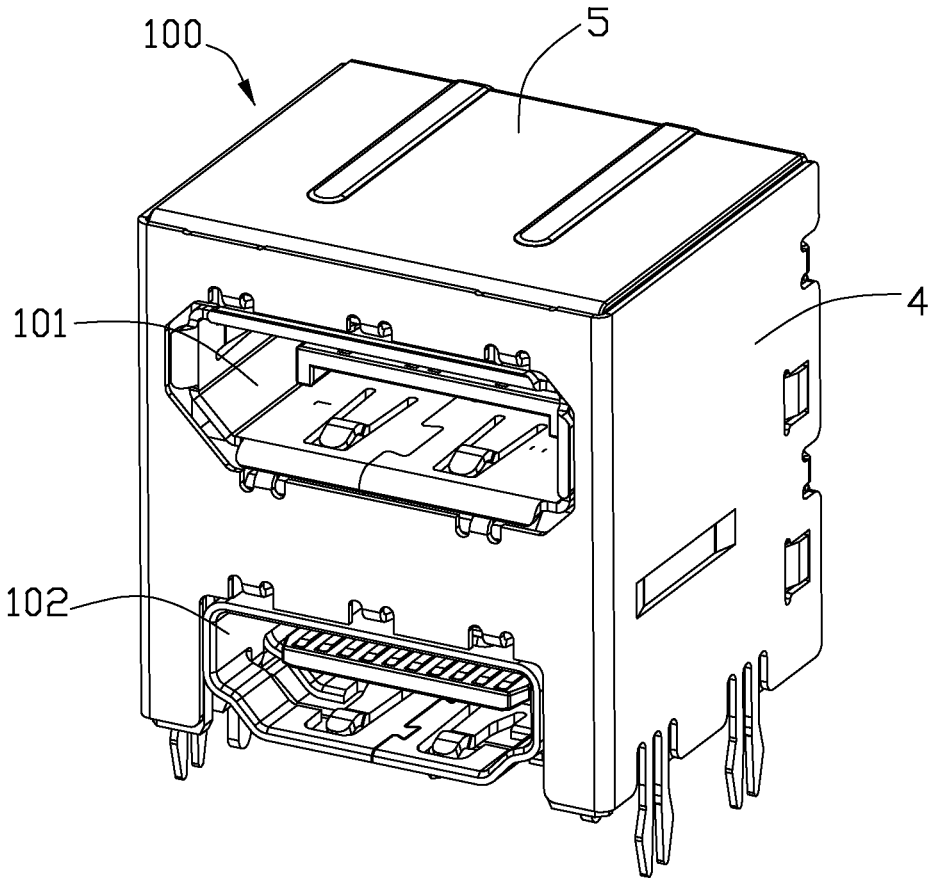
FIG. 1 is an assembled perspective view of an electrical connector according to a preferred embodiment of the present invention.
Figure 2:
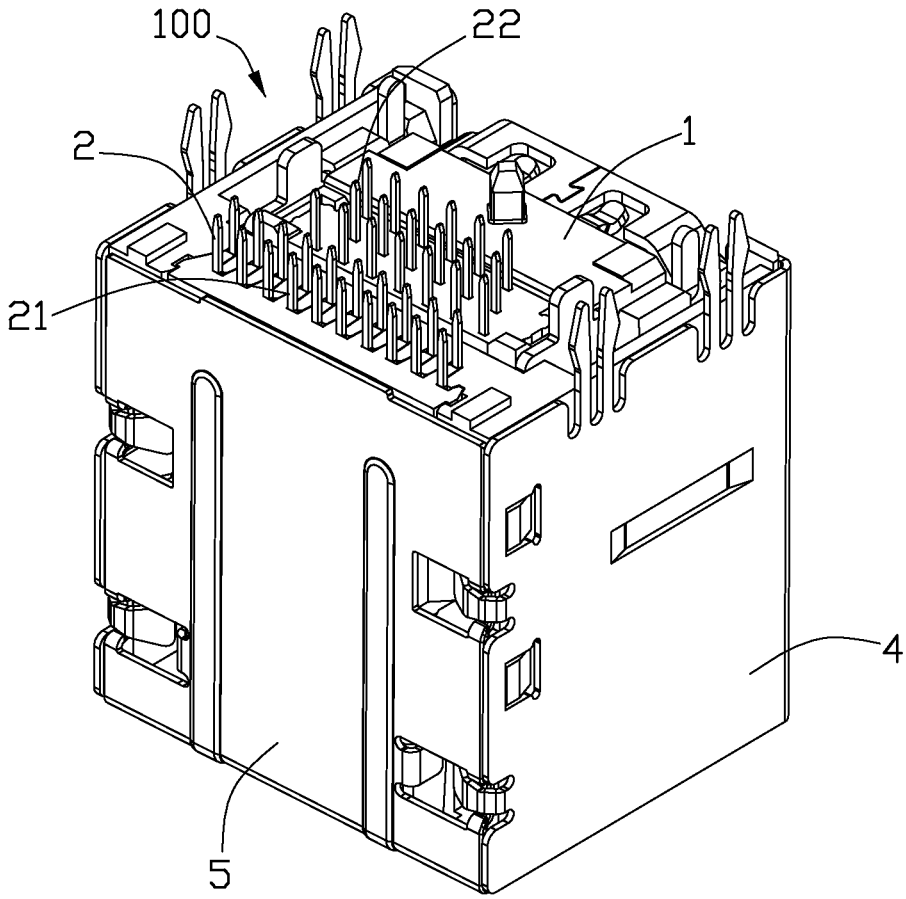
FIG. 2 is another assembled perspective view of the electrical connector as shown in FIG. 1 taken from a bottom side.
Figure 3:
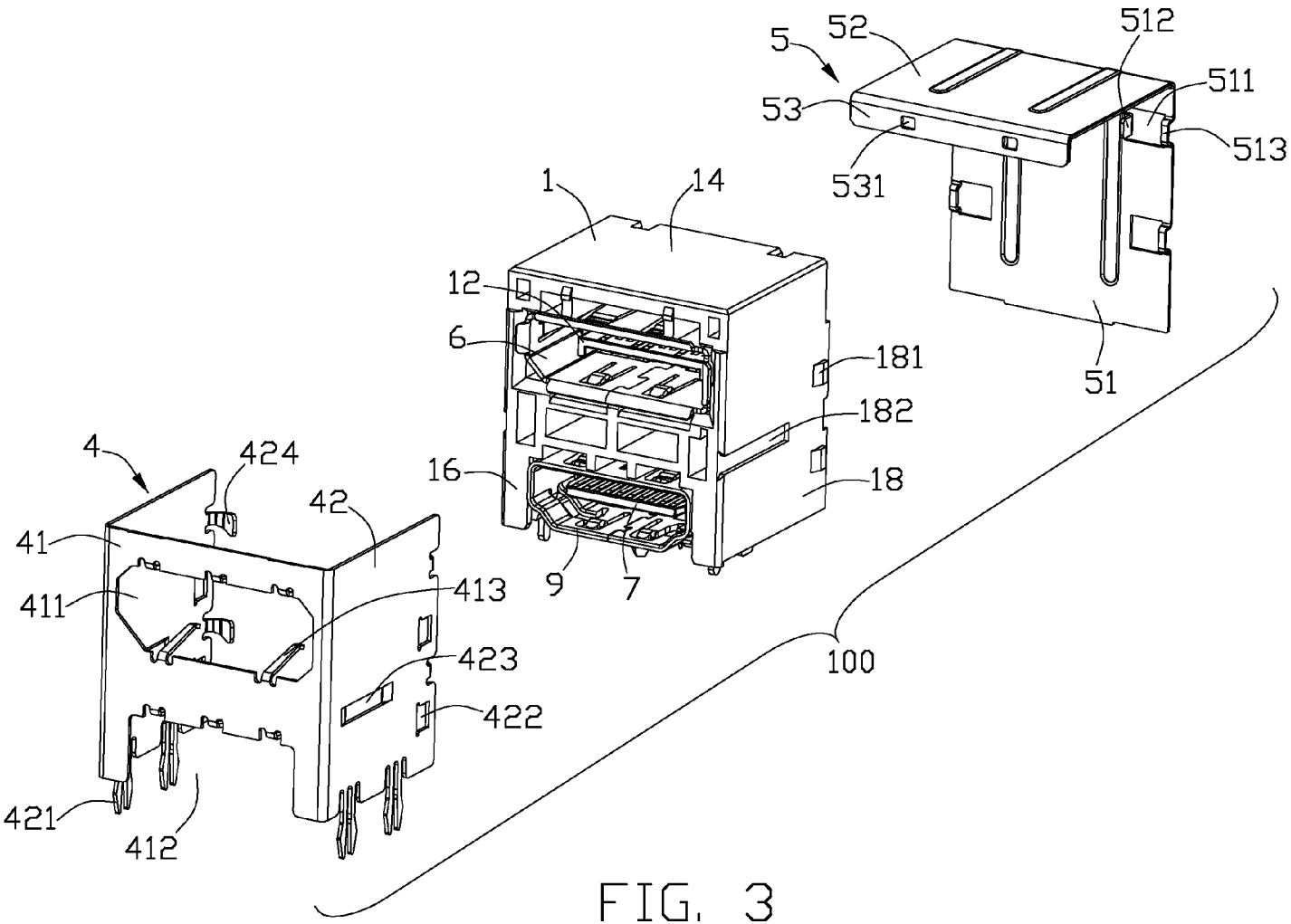
FIG. 3 is a partially exploded perspective view of the electrical connector.
Figure 4:
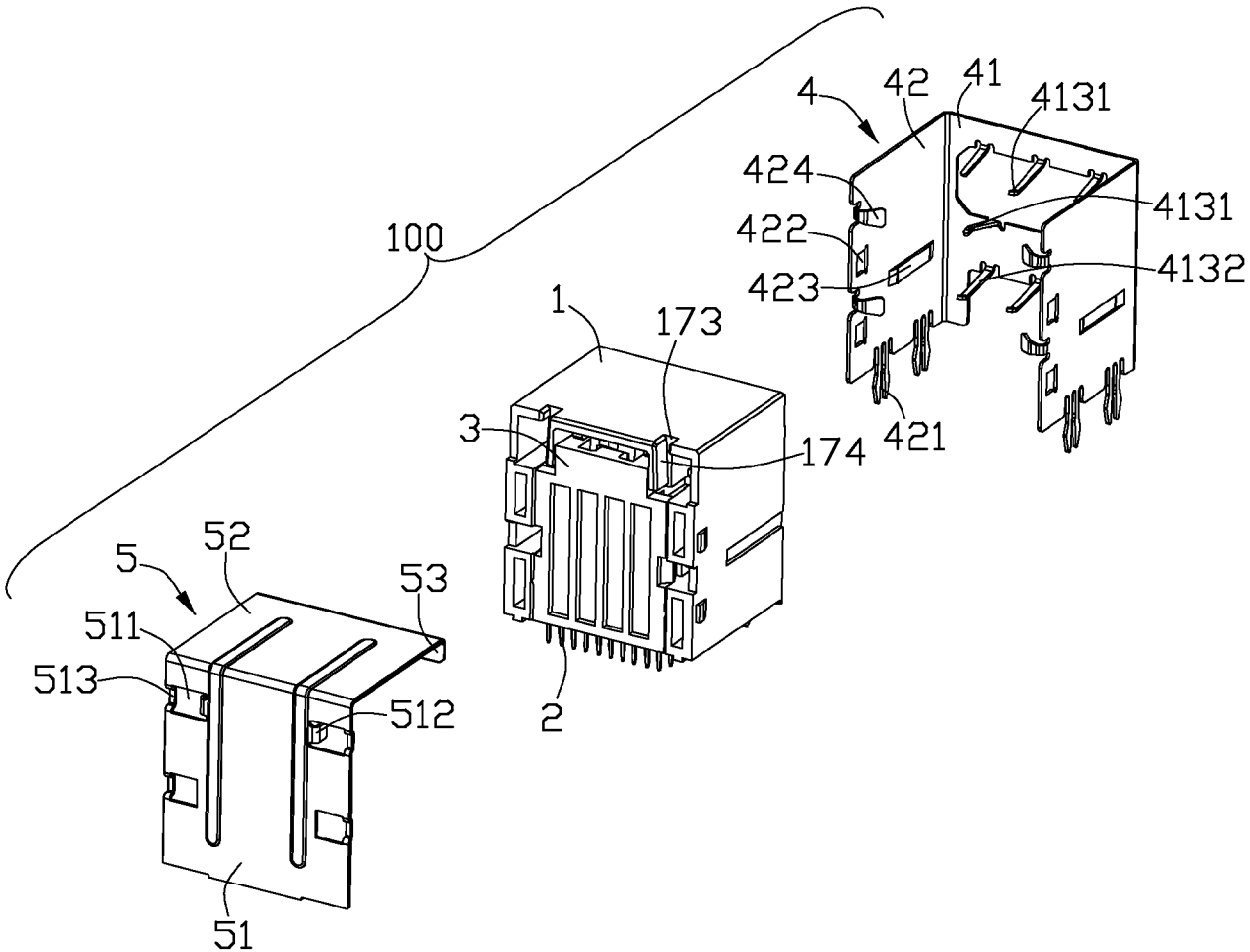
FIG. 4 is another exploded view of the electrical connector as shown in FIG. 3.

Reference will now be made to the drawing figures to describe the preferred embodiment of the present invention in detail.

Referring to FIGS. 1-5, an electrical connector 100 is mounted in the printed circuit board and can mate with two different mating connectors. The electrical connector 100 has a first connector 101 (Displayport connector) and a second connector 102 (HDMI connector). The electrical connector 100 includes an insulative housing 1, a plurality of contacts 2 received in the insulative housing 1, an insulative lump 3 mounted to a back of the insulative housing 1, a front shell 4 covering a front of the insulative housing 1 and a back shell 5 covering the back of the insulative housing 1.

Figure 6:
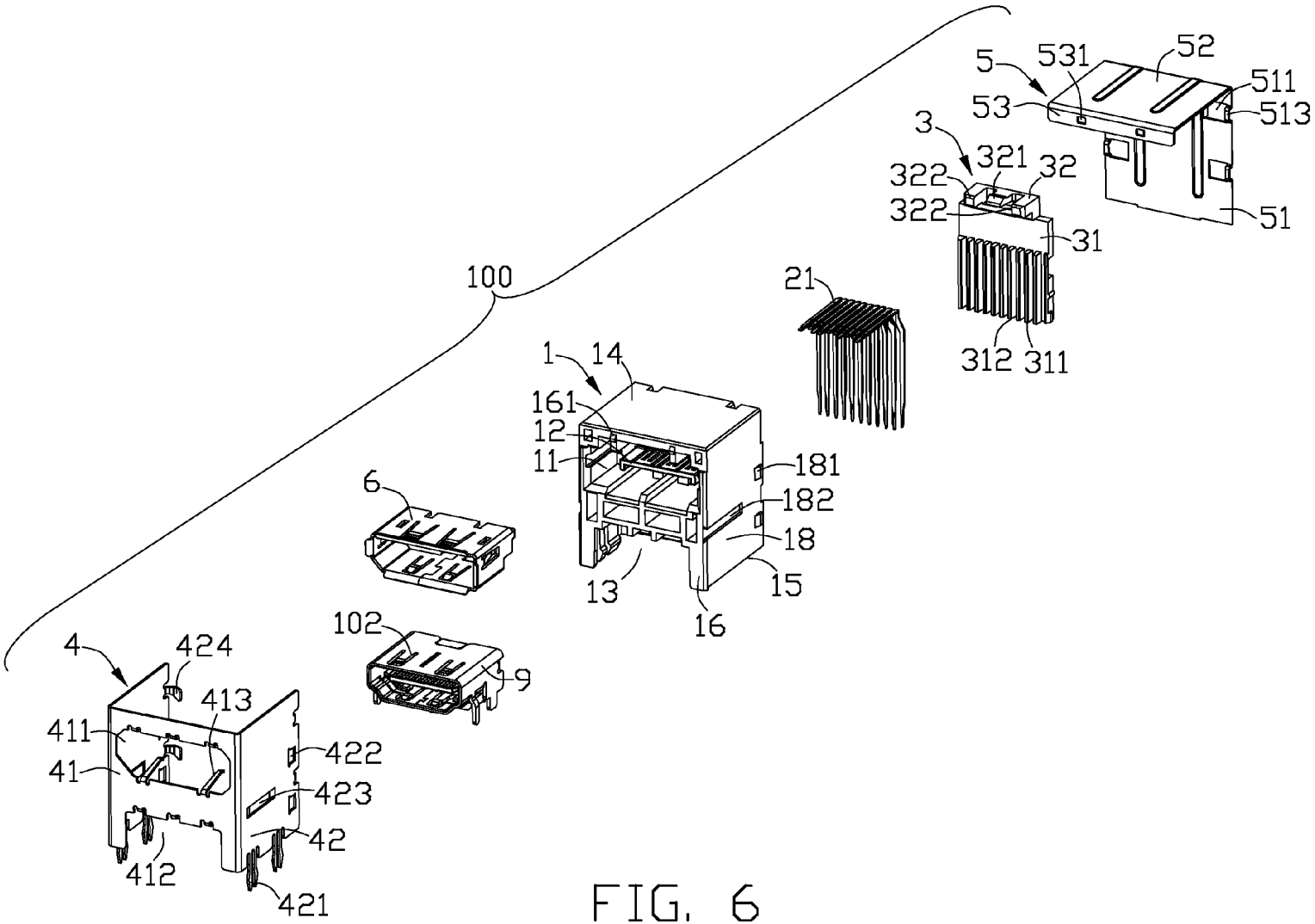
FIG. 6 is a further exploded perspective view of the electrical connector as shown in FIG. 3.
Figure 7:
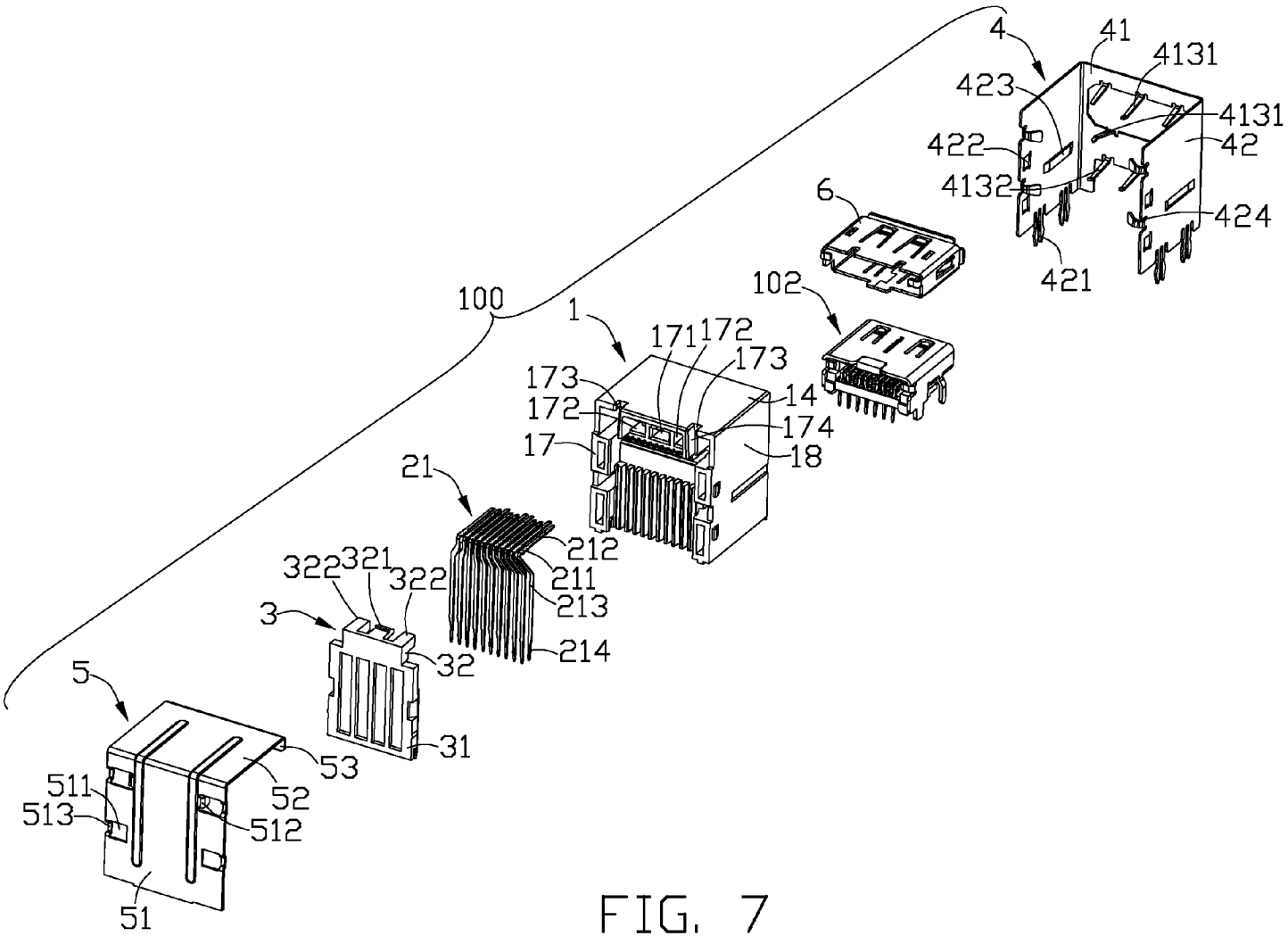
FIG. 7 is similar with FIG. 6, but taken from another side.
Figure 8:
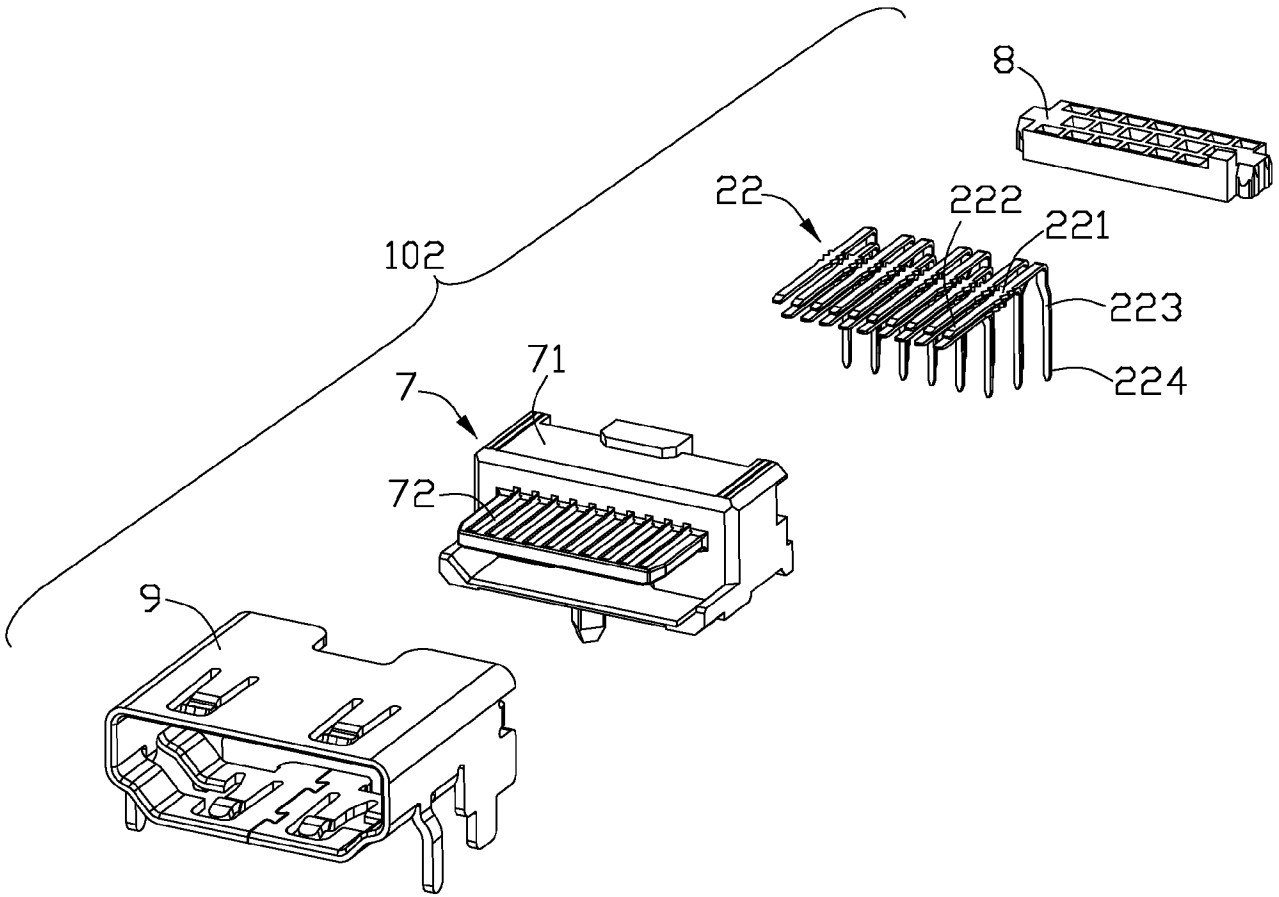
FIG. 8 is an exploded view of a second electrical connector of the electrical connector.
Figure 9:
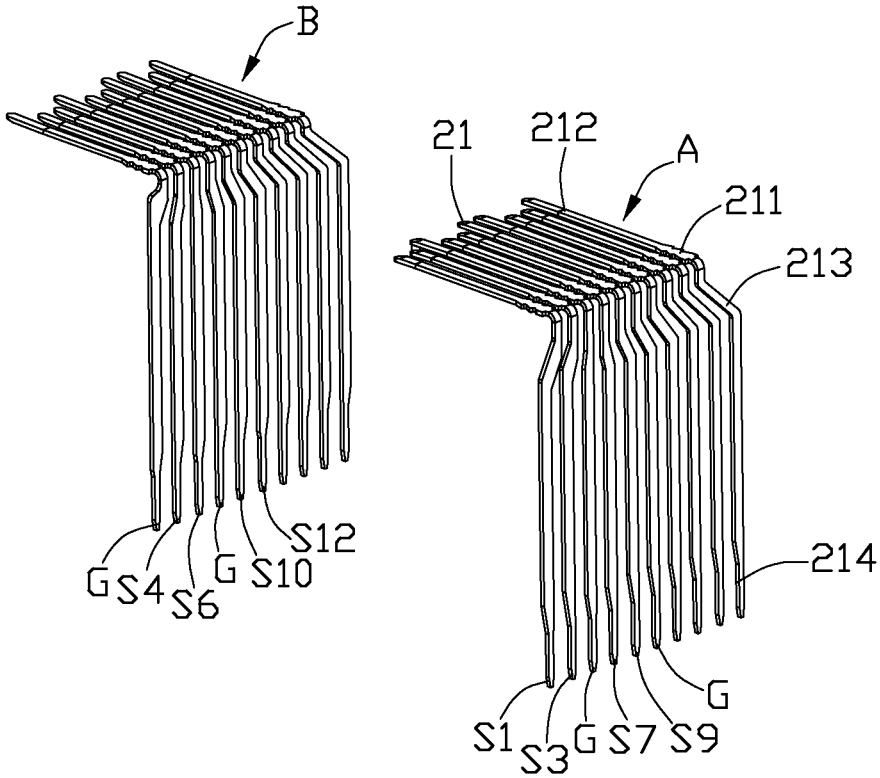
FIG. 9 is an exploded perspective view of a plurality of first contacts of the electrical connector.

Referring to FIGS. 6-7, the insulative housing 1 includes an upper inserting opening 11 located in the top of the insulative housing 1, a first tongue 12 extending forwardly into the upper inserting opening 11 and a lower mounting space 13 located under the upper inserting opening 11. The second connector 102 is mounted in the lower mounting space 13 as an independent structure. The insulative housing 1 includes a top face 14, a bottom face 15, a front face 16, a back face 17 and two side faces 18. A top of the front face 16 has a first locking portion 161 for latching with the back shell 5. The side face 18 includes a plurality of second locking portions 181 for latching with the front shell 4 and two transversal slots 182 extending along a front-to-back direction for engaging with the front shell 4. The transversal slots 182 extend forwardly to the front face 16. A first locking slot 171 and two second locking slots 172 for engaging with the insulative lump 3 and two guiding slots 173 for engaging with the back shell 5 are defined by depressing forwardly from the back face 17 of the insulative housing 1. The second locking slots 172 is located in two opposite sides of the first locking slots 171 and the guiding slots 173 are located in an out sides of the second locking slots 172, respectively. An inside of the guiding slots 173 has an inclined wall 174 to guide the back shell 5 to mount to the insulative housing 1.

Figure 5:
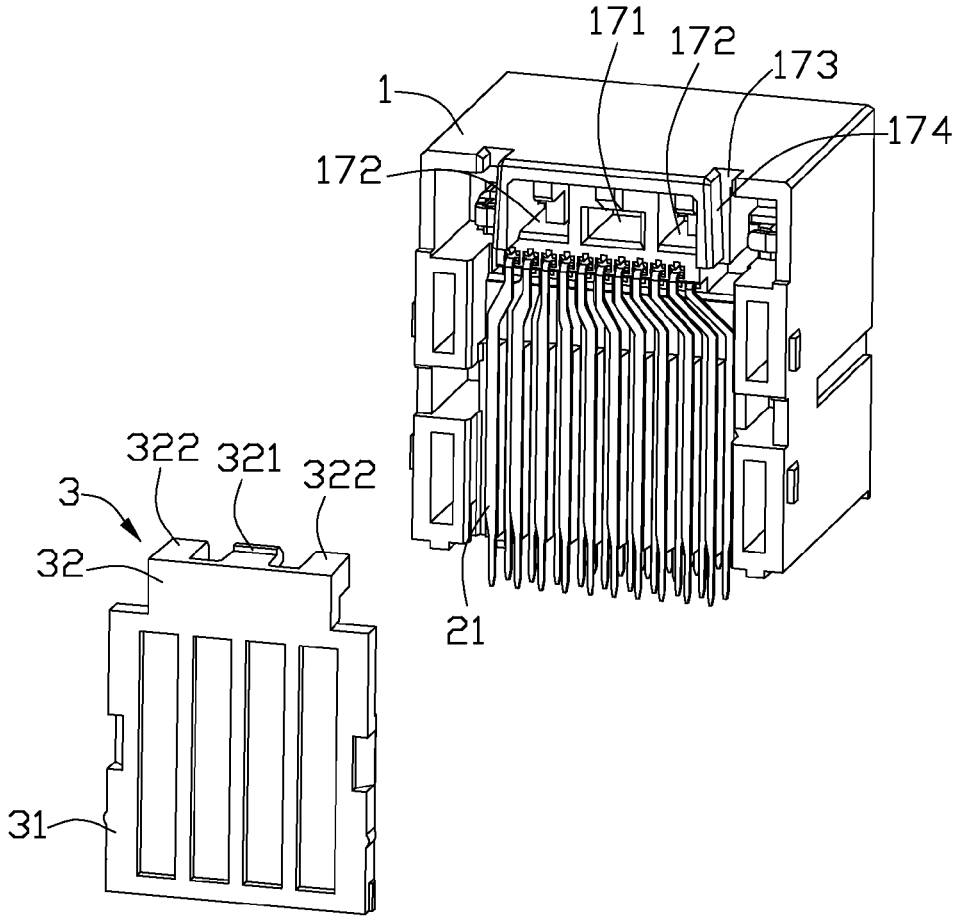
FIG. 5 is a partially exploded perspective view of the electrical connector without a front shell and a back shell thereof.
Figure 10:
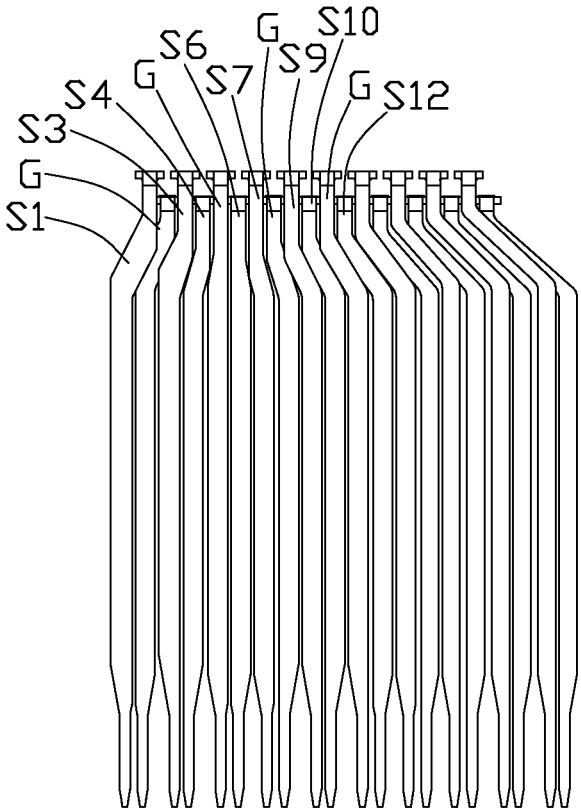
FIG. 10 is a back plan view of the first contacts.
Figure 11:
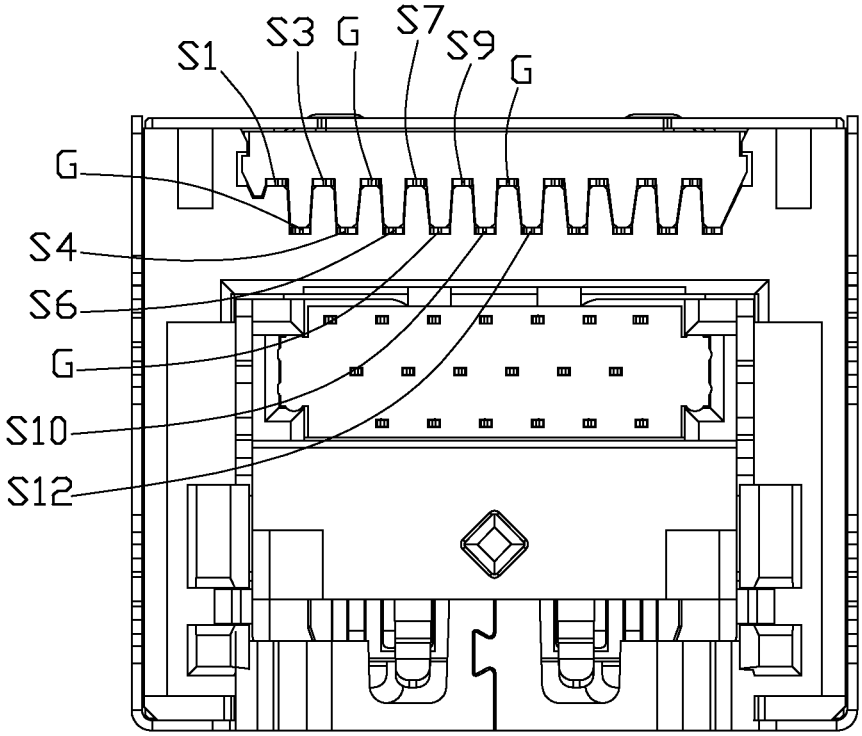
FIG. 11 is a bottom view of the electrical connector.

Referring to FIGS. 6-9, the contacts 2 include a plurality of first contacts 21 received in the first connector 101 and a plurality of second contacts 22 received in the second connector 102. The first contact 21 includes a first mounting portion 211, a first contacting portion 212 extending forwardly from the first mounting portion 211, a first extending portion 213 extending vertically and downwardly from the first mounting portion 211 and a first soldering portion 214 extending downwardly from the extending portion 213 and extending out of the insulative housing 1. The first extending portions 213 are arranged in a front row and a rear row. Two adjacent first extending portions 213 in a left side of a rear row are wider than the other first extending portions 213. The second contact 22 includes a second mounting portion 221, a second contacting portion 222 extending forwardly from the second mounting portion 221, a second extending portion 223 extending vertically and downwardly from the second mounting portion 221 and a second soldering portion 224 extending downwardly from the second extending portion 223 and extending out of the insulative housing 1. It is noted that the first soldering portions 214 defines a pitch larger than another pitch defined by the first mounting portions 211, thus requiring portions of the corresponding first extending portions 213 linked therebetween in an oblique manner. It is further noted that to keep those extending portions 213 generally parallel to one another, the first extending portions 213 have different lengths from one another wherein the farther from the base first extending portion 213 which is essentially not oblique, the first extending portion 213 is, the longer the corresponding first extending portion 213 is. Therefore, as shown in FIG. 5, the oblique portions of the first extending portions 213 commonly define a triangular configuration in an elevation view Referring to FIGS. 9-11, the first contacts 21 include a plurality of signal contacts S1, S3, S4, S6, S7, S9, S10, S12 and a plurality of grounding contacts G The first contacts 21 include a first group of contacts A located in the rear row and a second group of contacts B located in the front row. The first to the sixth contacts of the first group are S1, S3, G, S7, S9, G from left side to right side. The first to the sixth contacts of the second group are G, S4, S6, G, S10, S12 from left side to right side. Referring to FIG. 11, the grounding contacts G are located in the front and the right sides of the signal contacts S1, S3. The grounding contacts G are located in the left, right and rear sides of the signal contacts S4, S6. The grounding contacts G are located in the left, right and front sides of the signal contacts S7, S9. The grounding contacts G are located in the left, right and rear sides of the signal contacts S10, S12. Because of the electrical connector 100 is a stacked connector, the first connector 101 is located in a top of the electrical connector 100, the first extending portions 213 of first contacts 21 are litter longer. Since three are two grounding contacts G around the single contacts S1, S3, while there are three grounding contacts G around the other single contacts S4, S6, S7, S9, S10, S12, so the impedance of the signal contacts S1, S3 is obviously different from the impedance of the other signal contacts. In this invent, the first extending portion 213 of signal contacts S1, S3 are designed wider than the other first extending portion 213 to remedy the difference.

Referring to FIGS. 3-6, the first connector 101 is not an independent structure. The first connector 101 includes a first inside shell 6 backwardly insert into the upper inserting opening 11 along a front-to-back direction. The first connector 101 is made up of the insulative housing 1, the first tongue 12, the first contacts 12 and the first inside shell 6. The second connector 12 includes an insulator 7 having a body portion 71 and a second tongue 72 extending forwardly from the body portion 72, the second contacts 22 received in the insulator 7, a spacer 8 for retaining the second contacts 22 and a second inside shell 9 covering the insulator 7.

Referring to FIGS. 6-7, the insulative lump 3 includes a base board 31 and a locking member 32 at a top of the base board 31. A plurality of ribs 311 extending along a top-to-bottom direction and protruding from a front surface of the base board 31 and a retaining slot 312 which is defined between two adjacent ribs 311 for preventing the first contacts 21 from moving. The locking member 32 includes a retaining member 321 to be received in the first locking slot 171 of the insulative housing 1 and two retaining convexes 322 in two sides of the retaining member 321 to be received in the second locking slot 172 of the insulative housing 1. The retaining member 321 and the retaining convexes 322 are all above the ribs 311.

The front shell 4 includes a front wall 41 having a first opening 411 corresponding to the upper inserting opening 11 and a second opening 412 corresponding to the lower mounting space 13 and two first side walls 42 extending backwardly from two sides of the front wall 41. The first side walls 42 include a plurality of board locks 421 extending backwardly for soldering in the printed circuit board, a second locking hole 422 latching with the second locking portion 181 and two attaching portions 423 latching with the transversal slots 182 and guiding the front shell 4 along a front-to back direction. The first side walls 42 includes a protruding portion 424 bent backwardly form a back edge of the first side walls 42 for engaging with the back shell 5. The front wall 41 of the front shell 4 includes a plurality of elastic grounding plates 413 contacting with the first and second inside shells 6, 9. The elastic grounding plates 413 include a plurality of first grounding plates 4131 extending backwardly from a top and a bottom edges of the first opening 411 to contact with the first inside shell 6 and a plurality of second grounding plate 4132 extending backwardly from a top edge of the second opening 412 to contact with the second inside shell 9.

The back shell 5 includes a base 51 forwardly covering the back face 17 of the insulative housing 1, an extending wall 52 bent forwardly from a top edge of the base 51 and extending horizontally and an inclined wall 53 bent downwardly from a front edge of the extending wall 52 and extending vertically. The inclined wall 53 includes two first locking holes 531 connecting with the first locking portions 161 of the insulative housing 1. The back shell 5 further includes four through holes 511 and two mounting plates 512 retained in the guiding slots 173. The base 51 has a plurality of locking edge 513 in outside of each through holes 511. The through holes 511 make the protruding portion 424 of the front shell 4 latching with the locking edge 53 conveniently.

The mounting plates 512 extend from inner edges of upper two through holes 511. The back shell 5 is attached to the insulative housing 1 from top-to-bottom, and the mounting plate 512 is guided by the inclined wall 174 of the insulative housing 1 into the guiding slot 173.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a back face in a back of the insulative housing and a top face in a top of the insulative housing;

a plurality of contacts retained in the insulative housing; and a back shell comprising a base covering the back face of the insulative housing and an extending wall extending forwardly from a top edge of the base and covering the top face of the insulative housing; wherein the insulative housing comprises at least one guiding slot depressed forwardly from the back face and upwardly passing through the insulative housing, the back shell is assembled to the insulative housing from a top-to-bottom direction and has at least one mounting plate extending forwardly from the base and sliding in the guiding slot to guide the back shell, wherein the guiding slot has an inclined wall for guiding the mounting plate, wherein the back shell comprising a plurality of through holes, the mounting plate from an inside edge of the through hole, the back shell comprises a locking edge extending from an outside of the through hole, the electrical connector further comprises a front shell assembled with the back shell, the front shell has a protruding portion assembled with the locking edge, wherein the electrical connector comprises a first inside shell retained to the insulative housing and a second inside shell, the front shell comprises a plurality of first grounding plates contacting with the first inside shell and a plurality of second grounding plates contacting with the second inside shell.

2. The electrical connector as claimed in claim 1, wherein the insulative housing has two said guiding slots, and the back shell has two said mounting plates.

3. The electrical connector as claimed in claim 1, further comprising an insulative lump mounted to the back of the insulative housing, the insulative lump comprises a retaining member and two retaining convexes, the insulative housing has a first locking slot latching with the retaining member and two second locking slots latching with the retaining convexes.

4. The electrical connector as claimed in claim 3, wherein the two retaining convexes are located in two sides of the retaining member.

5. The electrical connector as claimed in claim 3, wherein the insulative lump comprises a plurality of ribs extending outsidely along the top-to-bottom direction and a retaining slot located between two adjacent ribs, the retaining convexes and the retaining member are located above the ribs.

6. The electrical connector as claimed in claim 1, wherein the electrical connector has a first connector and a second connector, the first connector has a plurality of first contacts arranged into two rows, the first contact comprising a first mounting portion, a first contacting portion extending forwardly from the first mounting portion, a first extending portion extending vertical and downwardly from the first mounting portion and a first soldering portion extending downwardly from the extending portion and extending out of the insulative housing, two first extending portions of two of the first contacts which are located at the first and the second position of one row in the outside along a left-to-right direction are designed wider than the other first extending portion.

7. The electrical connector as claimed in claim 6, wherein the first contacts comprises a plurality of signal contacts and a plurality of grounding contacts, the two wider extending portions of the first contacts are signal contacts.

8. An electrical connector comprising:

an insulative housing having a back face in a back of the insulative housing;

a plurality of contacts retained in the insulative housing; and an insulative lump mounted to the back of the insulative housing;

the insulative housing comprises a first locking slot and a second locking slot depressed forwardly from the back face, the insulative lump comprises a retaining member latching with the first locking slot and a retaining convex latching with the second locking slot, wherein the insulative housing comprises a guiding slot depressed forwardly, the electrical connector further comprises a back shell having a mounting plate extending forwardly and retained in the guiding slot, wherein the guiding slots pass upwardly through the insulative housing, the back shell is mounted to the insulative housing along an top-to-bottom direction, the insulative housing comprises an inclined wall disposed in the guiding slot for guiding the mounting plate, wherein the back shell comprising a plurality of through holes, the mounting plate from an inside edge of the through hole, the back shell comprises a locking edge extending from an outside of the through hole, the electrical connector further comprises a front shell assembled with the back shell, the front shell has a protruding portion assembled with the locking edge.

9. The electrical connector as claimed in claim 8, wherein the insulative lump has two retaining convexes located on two sides of the retaining member.

10. The electrical connector as claimed in claim 8, wherein the insulative lump comprises a plurality of ribs extending outsidely along an top-to-bottom direction and a retaining slot located between two adjacent ribs, the retaining convexes and the retaining member are located above the ribs.

11. An electrical connector assembly comprising: an insulative housing defining a mating tongue; at least one row of passageways commonly disposed in the housing along a transverse direction while individually extending along a front-to-back direction perpendicular to said transverse direction; a plurality of contacts disposed in the housing, each of the contacts including a contacting portion disposed in the corresponding passageway via a corresponding mounting portion, a soldering portion extending downwardly and secured around a rear face of the housing, and an extending portion downwardly linked between the mounting portion and the soldering portion, the extending portion includes an oblique section thereof; and an insulative lump attached to the rear face of the housing to respectively regulate the corresponding contacts; wherein the soldering portions define a first pitch which is larger than a second pitch defined by the mounting portions, the oblique sections are generally parallel to and have different lengths from one another in a triangular configuration under condition that a shortest one of said oblique sections is deemed as a base and the farther from said base the oblique section is, the longer oblique section is a metallic front shell joined with a metallic rear shell to commonly cover portions of the housing; a metallic upper shell rearwardly assembled to the housing to enclose the mating tongue; wherein the housing further defines a lower mounting space communicating downwardly and forwardly with an exterior, and another connector equipped with a metallic lower shell enclosing an insulator and another set of contacts, is upwardly assembled into the lower mounting space.

12. The electrical connector assembly as claimed in claim 11, wherein said housing defines in the lower mounting space protrusions abutting against an underside of the metallic lower shell.

13. The electrical connector assembly as claimed in claim 11, wherein the metallic upper shell is discrete from but contacted with the metallic front shell.

* * * * *